US005717290A

United States Patent [19]

Shaffer

[11] Patent Number: 5,717,290

[45] Date of Patent: Feb. 10, 1998

[54] STARTING FLAG STRUCTURE FOR TUBULAR LOW PRESSURE DISCHARGE LAMPS

[75] Inventor: John W. Shaffer, Danvers, Mass.

[73] Assignee: OSRAM Sylvania Inc., Danvers, Mass.

[21] Appl. No.: 721,521

[22] Filed: Sep. 26, 1996

[51] Int. Cl.[6] ..... H01J 1/62; H01J 63/04; H01J 17/22; H01J 19/70

[52] U.S. Cl. ..... 313/545; 313/490; 313/493

[58] Field of Search ..... 313/490, 491–93, 313/564–66, 571, 637–39, 545–47, 634, 550–51, 563, 238, 243, 247, 252, 253, 255, 274; 315/248, 344, 160, 161

[56] References Cited

U.S. PATENT DOCUMENTS

| | | | |
|---|---|---|---|
| 3,227,907 | 1/1966 | Bernier et al. | 313/178 |
| 3,336,502 | 8/1967 | Gilliatt | 315/108 |
| 3,504,215 | 3/1970 | Evans | 313/490 |
| 3,634,717 | 1/1972 | Boucher et al. | 313/490 X |
| 4,234,817 | 11/1980 | Teshima et al. | 313/493 |
| 4,262,231 | 4/1981 | Anderson et al. | 313/490 |
| 4,480,213 | 10/1984 | Lapatovich et al. | 313/607 X |
| 4,528,209 | 7/1985 | Anderson et al. | 427/67 |
| 4,622,495 | 11/1986 | Smeelen | 313/547 X |
| 4,647,821 | 3/1987 | Lapatovich et al. | 315/248 |
| 4,704,562 | 11/1987 | Postma et al. | 315/248 |
| 4,972,118 | 11/1990 | Yorifuji et al. | 313/565 |
| 5,055,738 | 10/1991 | Yorifuji et al. | 313/490 |
| 5,204,584 | 4/1993 | Ikeda et al. | 313/565 |
| 5,373,216 | 12/1994 | Dakin et al. | 315/344 |
| 5,412,288 | 5/1995 | Borowiec et al. | 315/248 |
| 5,500,567 | 3/1996 | Wilson et al. | 315/344 X |
| 5,559,392 | 9/1996 | Cocoma et al. | 315/394 X |

*Primary Examiner*—Sandra L. O'Shea
*Assistant Examiner*—Mach Haynes
*Attorney, Agent, or Firm*—Carlo S. Bessone

[57] ABSTRACT

An electric lamp includes a tubular lamp envelope enclosing mercury vapor and a buffer gas, and a flag assembly located within the lamp envelope. The lamp envelope has a pair of dimples on an inside surface thereof. The flag assembly includes a support wire having opposite ends secured to the dimples and a starting flag attached to the support wire. The starting flag includes a mercury-absorbing material. The lamp envelope may be a closed loop electrodeless lamp envelope or a conventional electroded fluorescent lamp envelope.

31 Claims, 3 Drawing Sheets

STARTING FLAG STRUCTURE FOR TUBULAR LOW PRESSURE DISCHARGE LAMPS

FIELD OF THE INVENTION

This invention relates to tubular, low pressure discharge lamps and, more particularly, to a starting flag structure for use within tubular lamp envelopes. The starting flag structure is particularly useful in electrodeless lamps, but is not limited to such use.

BACKGROUND OF THE INVENTION

The light output of fluorescent lamps is critically dependent on the mercury vapor pressure (vapor density) within the lamp envelope. The mercury vapor pressure, in turn, is controlled by the temperature of the excess liquid mercury which condenses in the coldest part of the lamp envelope, the so-called cold spot. When lamps are operated at temperatures lower or higher than the optimum ambient temperature, the light output decreases by as much as 30% or even more relative to its peak value. This is a common occurrence when lamps are operated in enclosed or semi-enclosed fixtures. In addition to reduced light output, the color of the light varies as a result of the varying contribution of blue spectral emission from the mercury vapor in the discharge.

Alloys of low temperature melting metals are often placed within fluorescent lamps to amalgamate with the excess mercury, and to regulate the mercury vapor pressure within the lamp. The amalgam is commonly located in an exhaust tubulation or other relatively cool region of the lamp. Such amalgams reduce the mercury vapor pressure relative to that of pure mercury at any given temperature and thereby permit optimum light output at elevated temperatures. Such amalgams also provide a broadened peak in the light output versus temperature curve, so that near optimum light output is obtained over an extended range of ambient temperatures.

When an amalgam fluorescent lamp is turned off, the amalgam itself cools and the mercury vapor within the lamp is gradually absorbed into the amalgam. The mercury vapor pressure in a cool, non-operating amalgam lamp is therefore much lower than it is in a non-amalgam lamp. When the lamp is turned on, the lumen output is significantly reduced until the amalgam is warmed up to a point where it emits sufficient mercury vapor to permit efficient lamp operation. This may require from several to many minutes depending on the lamp construction.

In order to hasten the lumen runup rate of amalgam lamps, it is common to provide a small quantity of a secondary amalgam in a region of the lamp which warms up rapidly, such as for example near an electrode. At the time of turn on, radiated heat from the electrode helps to release mercury vapor from the secondary amalgam, after which the lamp operates much as a pure mercury lamp until any excess released mercury is absorbed into the main amalgam body. Such secondary amalgams are often provided as a thin coating on a metal foil flag that is attached to the electrode mount structure and is located so as to be rapidly heated by the adjacent electrode. Flags attached to electrode mount structures within fluorescent lamps are disclosed in U.S. Pat. No. 3,227,907 issued Jan. 4, 1966 to Bernier et al; U.S. Pat. No. 4,972,118 issued Nov. 20, 1990 to Yorifuji et al; U.S. Pat. No. 5,055,738 issued Oct. 8, 1991 to Yorifuji et al and U.S. Pat. No. 5,204,584 issued Apr. 20, 1993 to Ikeda et al. An automatic heater control system for amalgam pressure control in fluorescent lamps is disclosed in U.S. Pat. No. 3,336,502 issued Aug. 15, 1967 to Gilliatt. An amalgam disposed on a bimetallic element which is resiliently mounted against the wall of a fluorescent lamp is disclosed in U.S. Pat. No. 3,634,717 issued Jan. 11, 1972 to Boucher et al.

Electrodeless fluorescent lamps are disclosed in U.S. Pat. No. 3,500,118 issued Mar. 10, 1970 to Anderson; U.S. Pat. No. 3,987,334 issued Oct. 19, 1976 to Anderson; and Anderson, *Illuminating Engineering*, April 1969, pages 236 to 244. An electrodeless, inductively-coupled lamp, as disclosed in these references, includes a low pressure mercury/buffer gas discharge in a discharge tube which forms a continuous closed electrical path. The path of the discharge tube goes through the center of one or more toroidal ferrite cores such that the discharge tube becomes the secondary of a transformer. Power is coupled to the discharge by applying a sinusoidal voltage to a few turns of wire wound around the toroidal core that encircles the discharge tube. A current through the primary winding creates a time-varying magnetic flux which induces along the discharge tube a voltage that maintains the discharge. The inner surface of the discharge tube is coated with a phosphor which emits visible light when irradiated by photons emitted by the excited mercury atoms. The lamp parameters described by Anderson produce a lamp which has high core loss and is therefore extremely inefficient. In addition, the Anderson lamp is impractically heavy because of the ferrite material used in the transformer core.

An electrodeless lamp assembly having high efficiency is disclosed in U.S. application Ser. No. 08/624,043 filed Mar. 27, 1996. The disclosed lamp assembly comprises an electrodeless lamp including a closed-loop, tubular lamp envelope enclosing mercury vapor and a buffer gas at a pressure less than about 0.5 torr, a transformer core disposed around the lamp envelope, an input winding disposed on the transformer core and a radio frequency power source coupled to the input winding. The radio frequency source supplies sufficient radio frequency energy to the mercury vapor and the buffer gas to produce in the lamp envelope a discharge having a discharge current equal to or greater than about 2 amperes. The disclosed lamp assembly achieves relatively high lumen output, high efficacy and high axial lumen density simultaneously, thus making it an attractive alternative to conventional VHO fluorescent lamps and high intensity, high pressure discharge lamps.

Electrodeless fluorescent lamps do not contain electrodes or electrode mount structures. The gaseous discharge is driven by the electric field that is induced in the gaseous fill of the lamp by an oscillating magnetic field within a ferrite core. Accordingly, there may be no convenient way of mounting a starting flag in an electrodeless fluorescent lamp. Some electrodeless lamps with a bulb type construction have a reentrant cavity that projects axially into the bulb and can support a starting flag. Electrodeless fluorescent lamps wherein a starting flag is mounted to a reentrant cavity are disclosed in U.S. Pat. No. 4,622,495 issued Nov. 11, 1986 to Smeelen and U.S. Pat. No. 5,412,288 issued May 2, 1995 to Borowiec et al. A solenoidal electric field lamp having an amalgam mounted within a tipoff region of the lamp is disclosed in U.S. Pat. No. 4,262,231 issued Apr. 14, 1981 to Anderson et al and U.S. Pat. No. 4,528,209 issued Jul. 9, 1985 to Anderson et al.

None of the prior art starting flag structures have been satisfactory for use in a closed-loop, tubular, electrodeless lamp envelope.

SUMMARY OF THE INVENTION

According to the present invention, an electric lamp comprises a tubular lamp envelope enclosing mercury vapor and a buffer gas, and a flag assembly located within the lamp envelope. The lamp envelope has a pair of dimples on an inside surface thereof. The flag assembly comprises a support wire having opposite ends secured to the dimples and a starting flag attached to the support wire. The starting flag includes a mercury-absorbing material.

In a first embodiment, the dimples have an outwardly-extending, concave structure, and the opposite ends of the support wire are disposed in the dimples. In a second embodiment, the dimples have an inwardly-extending, concave structure, and the opposite ends of the support wire have loops disposed around the dimples.

The dimples are preferably located on opposite sides of the central axis of the tubular lamp envelope. The starting flag may be centered in the tubular lamp envelope so that it is located within the intense part of the discharge. Where the lamp envelope has a non-uniform inside diameter, the flag assembly is preferably located within a smaller diameter region where the discharge is most intense, in order to provide rapid heating of the starting flag.

The starting flag may comprise a non-volatile, mercury-absorbing metal, such as indium, or a non-volatile, mercury-absorbing alloy, such as indium and bismuth. In a preferred embodiment, the starting flag comprises a molecular sieve coating that is unaffected by heat during processing of the lamp envelope.

The lamp envelope may comprise a closed-loop, electrodeless lamp envelope. In a preferred embodiment, the lamp envelope comprises first and second parallel tubes joined at or near one end by a first lateral tube and joined at or near the other end by a second lateral tube. The flag assembly is located in the first lateral tube. Preferably, the first lateral tube has a smaller diameter than the parallel tubes. The lamp may further include an amalgam located in the second lateral tube.

According to another aspect of the invention, an electric lamp assembly is provided. The lamp assembly comprises an electrodeless, closed-loop, tubular lamp envelope enclosing mercury vapor and a buffer gas, and a flag assembly located within the lamp envelope. The lamp envelope has a pair of dimples on an inside surface thereof. The flag assembly comprises a support wire having opposite ends secured to the dimples and a starting flag attached to the support wire. The starting flag includes a mercury-absorbing material. The lamp assembly further comprises a transformer core disposed around the lamp envelope, an input winding disposed on the transformer core and a radio frequency power source coupled to the input winding for supplying sufficient radio frequency energy to the mercury vapor and the buffer gas to produce a discharge in the lamp envelope.

BRIEF DESCRIPTION OF THE DRAWINGS

For a better understanding of the present invention, reference is made to the accompanying drawings, which are incorporated herein by reference and in which.

DETAILED DESCRIPTION

Figure 1:
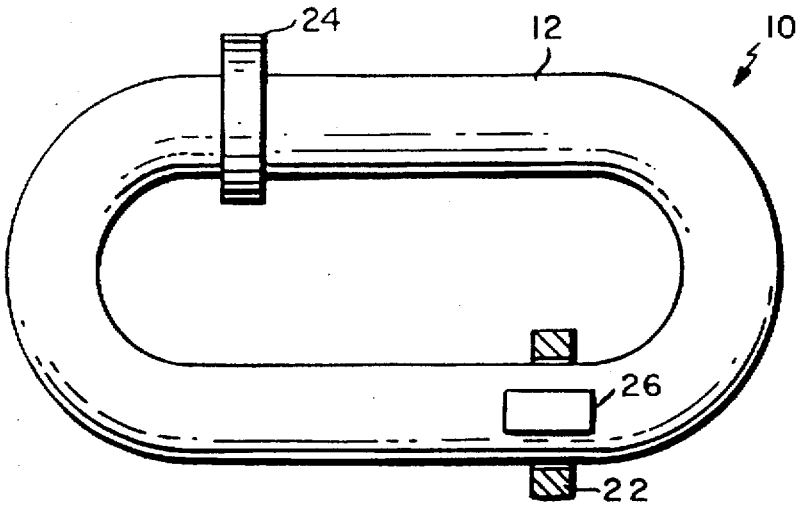
FIG. 1 is schematic diagram of a first embodiment of an electrodeless fluorescent lamp.
Figure 2:
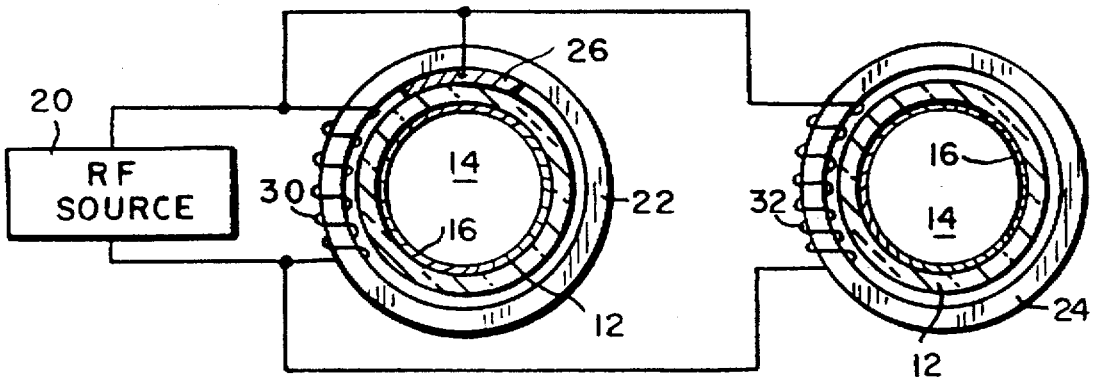
FIG. 2 is a schematic diagram showing electrical connections to the electrodeless fluorescent lamp of FIG. 1.

A first embodiment of a discharge lamp in accordance with the present invention is shown in FIGS. 1 and 2. A lamp 10 includes a lamp envelope 12 which has a tubular, closed-loop configuration and is electrodeless. The lamp envelope 12 encloses a discharge region 14 (FIG. 2) containing a buffer gas and mercury vapor. A phosphor coating 16 may be formed on the inside surface of lamp envelope 12. Radio frequency (RF) energy from an RF source 20 is inductively coupled to the electrodeless lamp 10 by a first transformer core 22 and a second transformer core 24. Each of the transformer cores 22 and 24 preferably has a toroidal configuration that surrounds lamp envelope 12. The RF source 20 is connected to a winding 30 on first transformer core 22 and is connected to a winding 32 on second transformer core 24. A conductive strip 26, adhered to the outer surface of lamp envelope 12 and electrically connected to RF source 20, may be utilized to assist in starting a discharge in electrodeless lamp 10.

In operation, RF energy is inductively coupled to a low pressure discharge within lamp envelope 12 by the transformer cores 22 and 24. The electrodeless lamp 10 acts as a secondary circuit for each transformer. The windings 30 and 32 are preferably driven in phase and may be connected in parallel as shown in FIG. 2. The transformers 22 and 24 are positioned on lamp envelope 12 such that the voltages induced in the discharge by the transformer cores 22 and 24 add. The RF current through the windings 30 and 32 creates a time-varying magnetic flux which induces along the lamp envelope 12 a voltage that maintains a discharge. The discharge within lamp envelope 12 emits ultraviolet radiation which stimulates emission of visible light by phosphor coating 16. In this configuration, the lamp envelope 12 is fabricated of a material, such as glass, that transmits visible light. In an alternative configuration, the electrodeless lamp is used as a source of ultraviolet radiation. In this configuration, the phosphor coating 16 is omitted, and the lamp envelope 12 is fabricated of an ultraviolet-transmissive material, such as quartz.

The lamp envelope preferably has a cross-sectional diameter in the range of about one inch to about four inches for high lumen output. The fill material comprises a buffer gas and a small amount of mercury which produces mercury vapor. The buffer gas is preferably a noble gas and is most preferably krypton. It has been found that krypton provides higher lumens per watt in the operation of the lamp at moderate power loading. At higher power loading, use of argon may be preferable. The lamp envelope 12 can have any shape which forms a closed loop, including an oval shape as shown in FIG. 1, a circular shape, an elliptical shape or a series of straight tubes joined to form a closed loop as described below.

The transformer cores 22 and 24 are preferably fabricated of a high permeability, low loss ferrite material, such as manganese zinc ferrite. The transformer cores 22 and 24 form a closed loop around lamp envelope 12 and typically have a toroidal configuration, with a diameter that is slightly larger than the outside diameter of lamp envelope 12. The windings 30 and 32 may each comprise a few turns of wire of sufficient size to carry the primary current. Each transformer is configured to step down the primary voltage and to step up the primary current, typically by a factor of about 5 to 10. The RF source 20 is preferably in a range of about 50 kHz to 3 MHZ and is most preferably in a range of about 100 kHz to about 400 kHz.

Figure 3:
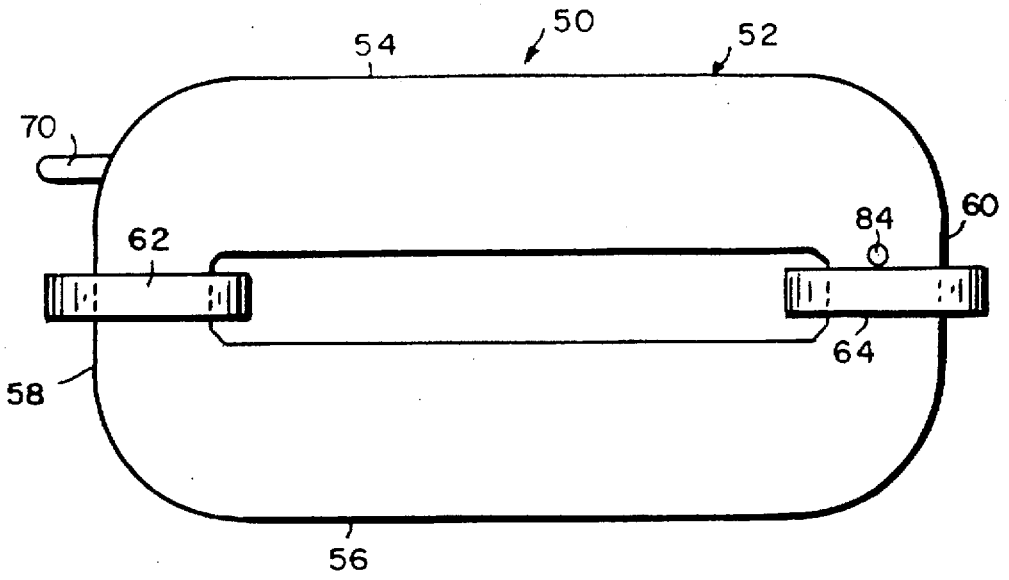
FIG. 3 is a schematic diagram of a second embodiment of an electrodeless fluorescent lamp.

A second embodiment of an electrodeless fluorescent lamp is shown in FIG. 3. An electrodeless lamp 50 comprises a lamp envelope 52 including two straight tubes 54 and 56 in a parallel configuration. The tubes 54 and 56 are interconnected at or near one end by a lateral tube 58 and are interconnected at or near the other end by a lateral tube 60. Each of the lateral tubes 58 and 60 provides gas communication between straight tubes 54 and 56, thereby forming a closed-loop configuration. The straight tubes 54 and 56 have an advantage over other shapes in that they are easy to make and easy to coat with phosphor. A process for fabricating electrodeless lamp envelope 52 is disclosed in pending application Ser. No. 08/650,245 filed May 22, 1996, which is hereby incorporated by reference. As noted above, the lamp envelope can be made in almost any shape, even an asymmetrical one, that forms a closed-loop discharge path. A transformer core 62 is mounted around lateral tube 58, and a transformer core 64 is mounted around lateral tube 60. In a preferred embodiment, straight tubes 54 have a larger diameter than lateral tubes 58 and 60. In one example, straight tubes 54 and 56 are 5 centimeters in diameter and lateral tubes 58 and 60 are 3.8 centimeters in diameter. The straight tube 54 includes an exhaust tubulation 70.

Figure 4:
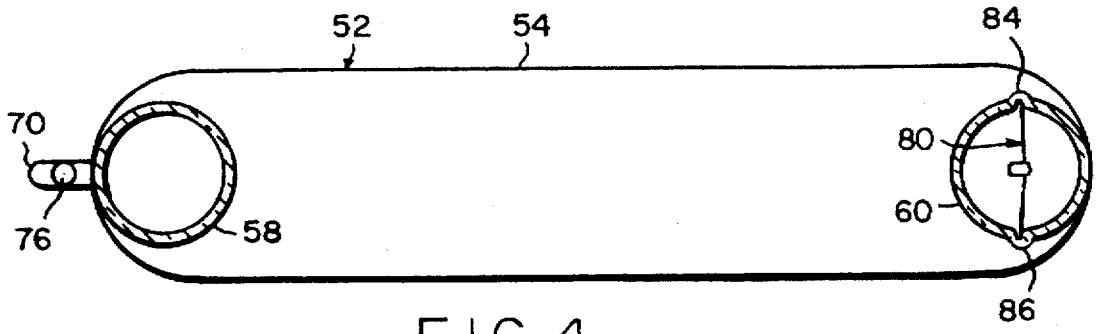
FIG. 4 is a cross-sectional view of the electrodeless fluorescent lamp of FIG. 3, showing a first embodiment of the starting flag structure.
Figure 5:
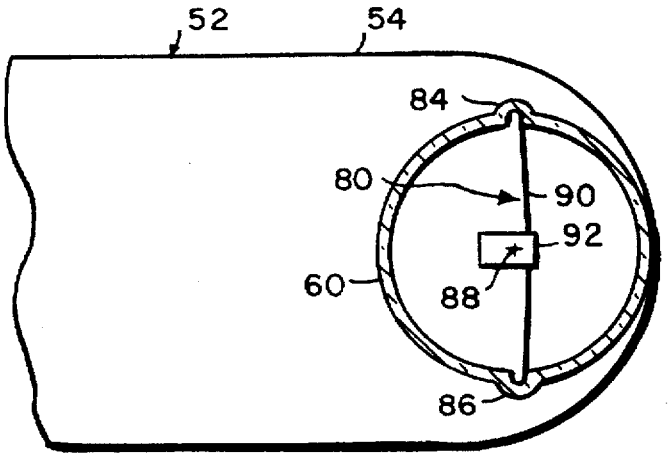
FIG. 5 is an enlarged, cross-sectional view of the electrodeless fluorescent lamp of FIG. 4, showing the first embodiment of the starting flag structure.

A cross-sectional view of lamp envelope 52, taken through lateral tubes 58 and 60, is shown in FIG. 4. An enlarged, partial cross-sectional view of lateral tube 60 is shown in FIG. 5. Transformer cores 62 and 64 are omitted from FIGS. 4 and 5 for clarity of illustration. An amalgam 76 for controlling mercury vapor pressure may be located within exhaust tubulation 70 at one end of lamp envelope 52 adjacent to lateral tube 58.

A first embodiment of the invention is illustrated in FIGS. 4 and 5. A flag assembly 80 is located within lateral tube 60 at the opposite end of lamp envelope 52 from exhaust tubulation 70. Because the lateral tubes 58 and 60 typically have smaller diameters than straight tubes 54 and 56, the current per unit cross-section and the discharge intensity are greater in the lateral tubes than in the straight tubes. The flag assembly 80 is preferably located within a region of the lamp envelope having reduced diameter and increased discharge intensity, so as to maximize the warmup rate and minimize the mercury vapor release time of the starting flag. This configuration provides the fastest possible lumen runup after turn-on of the lamp.

As best shown in FIG, 5, the flag assembly 80 is mounted within lateral tube 60 by providing dimples 84 and 86 in the glass lamp envelope. The dimples 84 and 86 project outwardly from the inside surface of the lamp envelope and have a concave configuration. The dimples 84 and 86 are preferably located on opposite sides of central axis 88 of lamp envelope 52 and most preferably are located 180° apart with respect to central axis 88. However, the dimples 84 and 86 may have other locations within the scope of the invention. In general, the dimples 84 and 86 must be located so retain opposite ends of flag assembly 80 over the life of the lamp. Each dimple may comprise a concave projection on the inside surface of the lamp envelope having sufficient depth and lateral dimension to retain one end of the flag assembly. The dimples are preferably integrally formed in the glass or other material of the lamp envelope. The dimples 84 and 86 may be formed by a suitable tool when the lamp envelope 52 is heated or may be formed by molding as described in the aforementioned application Ser. No. 08/650,245.

The flag assembly 80 includes a support wire 90 and a starting flag 92 attached to support wire 90. The support wire 90 has sufficient length to permit its ends to be inserted into dimples 84 and 86. The support wire extends across lateral tube 60 so that starting flag 90 is positioned in the discharge during operation. In a preferred embodiment, the starting flag 92 is approximately centered within lateral tube 60 and thus is located on central axis 88.

As described in the aforementioned application Ser. No. 08/650,245, the closed-loop lamp envelope is preferably fabricated by fusing two lamp halves together. One of the lamp halves is fabricated with dimples 84 and 86. The flag assembly 80 is flexed sufficiently to allow it to be inserted into dimples 84 and 86 before the two halves of the lamp envelope are sealed together. The support wire 90 has sufficient rigidity and/or spring tension to maintain flag assembly 80 in position during subsequent handling, shipping and operation of the lamp. Preferably, the support wire 90 is flexed at least slightly by dimples 84 and 86 to ensure that it remains in position. However, all that is required is that the ends of support wire 90 be retained within dimples 84 and 86 during the life of the lamp.

The support wire 90 may be made of nickel plated steel, stainless steel, molybdenum, tungsten, or any other material that will maintain sufficient stiffness, to remain in position in dimples 84 and 86 and to support starting flag 92 throughout the lamp life at the temperatures occurring within the lamp discharge. The starting flag 92 is preferably made of a section of expanded stainless steel foil that is welded to the center of support wire 90. The starting flag 92 may be coated with a relatively non-volatile, mercury-absorbing metal, such as indium, a mercury-absorbing alloy, such as indium and bismuth, or with a layer of adherent mercury-absorbing material, such as molecular sieve particles. The use of molecular sieve particles on a starting flag is disclosed in pending application Ser. No. 08/661,231 filed Mar. 22, 1996, which is hereby incorporated by reference. An advantage of the molecular sieve coating is that it is unaffected by oxidation by the heat of the subsequent glass sealing operation when the two lamp halves are joined together. Also, the molecular sieve coating avoids potential problems associated with surface wetting and migrating of an indium coating during the extended operating life that is characteristic of electrodeless fluorescent lamps.

In one example of a flag assembly in accordance with the invention, the support wire comprises tungsten and has a diameter of 0.010 inch. The flag comprises expanded stainless steel foil having dimensions of 3 mm×7 mm×0.2 mm thick and a coating of approximately 1.5 mg of molecular sieve UOP13X available from UOP Corporation, Des Plaines, Ill. 60017.

A flag assembly may be located in one or both of the lateral tubes 58 and 60. When only one flag assembly is utilized, it is preferable to place the flag assembly at the opposite end of the lamp envelope from the main amalgam 76. It will be understood that in some fluorescent lamp configurations, a main amalgam is not utilized. The flag assembly is preferably located in a reduced diameter portion of the lamp envelope but may be located at any convenient location within the lamp envelope. As shown in FIG. 3, the dimples 84 and 86 for locating flag assembly 80 are preferably located adjacent to transformer core 64. This eliminates any interference between dimples 84 and 86, and transformer core 64. The transformer core 64 preferably has an inside diameter just slightly larger than the outside diameter of lateral tube 60.

Figure 6:
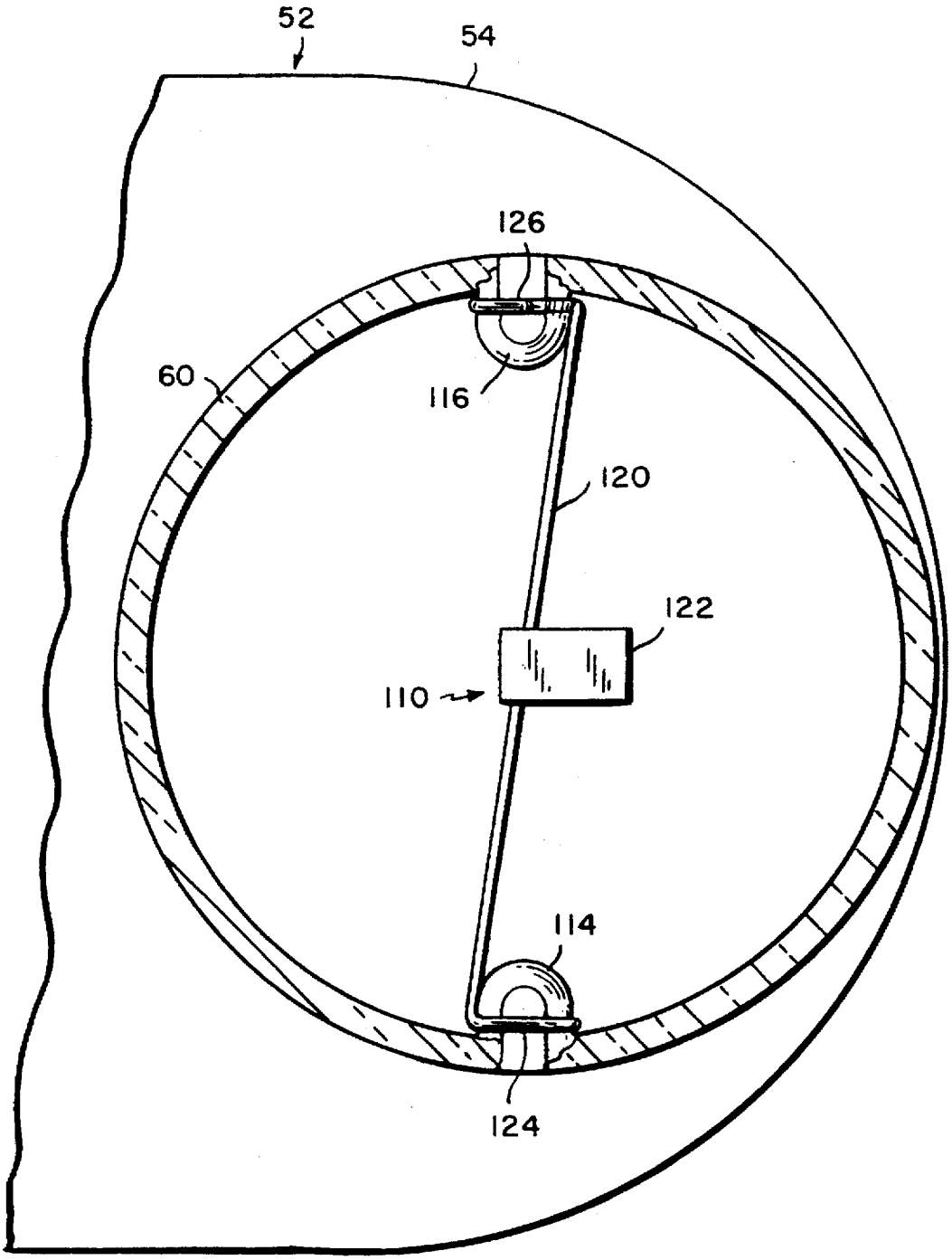
FIG. 6 is an enlarged, cross-sectional view of an electrodeless fluorescent lamp, showing a second embodiment of the starting flag structure.

A second embodiment of the invention is illustrated in FIG. 6. A flag assembly 110 is mounted within lateral tube 60 by providing dimples 114 and 116 in the glass envelope. The dimples 114 and 116 project inwardly from the inside surface of the lamp envelope and have a convex configuration. The dimples 114 and 116 are preferably located on opposite sides of the central axis of the lamp envelope and most preferably are located 180° apart with respect to the central axis. However, the dimples 114 and 116 may have other locations within the scope of the invention.

The flag assembly 110 includes a support wire 120 and a starting flag 122 attached to support wire 120. The ends of support wire 120 have loops 124 and 126 at opposite ends thereof which are secured around dimples 114 and 116, respectively. The support wire 120 extends across lateral tube 60, so that starting flag 122 is positioned in the discharge during operation. Preferably, the starting flag 122 is approximately centered within lateral tube 60. The support wire 120 and the starting flag 122 may be fabricated of the materials described above in connection with flag assembly 80. The inwardly-extending convex dimples 114 and 126 may be formed in a similar manner to the dimples 84 and 86 described above. The loops 124 and 126 engage dimples 114 and 116, respectively, so that the ends of support wire 120 are retained by dimples 114 and 116 during the life of the lamp. The inwardly-extending convex dimples 114 and 116 have an advantage in that they can be located within transformer core 62 and 64 without interference with the transformer core.

It will be understood that the flag assembly structures shown in FIGS. 4–6 and described above are not limited to use in electrodeless fluorescent lamps. More particularly, the flag assembly may be utilized in any tubular fluorescent lamp including conventional electroded fluorescent lamps having straight tubes and compact fluorescent lamps. In each case, the flag assembly is supported by dimples on the inside surface of the tubular lamp envelope. The flag assembly may be utilized in lamps which include a main amalgam and in lamps which do not include a main amalgam. The starting flag structure disclosed herein ensures that the starting flag may be located in an intense region of the discharge for rapid heating.

While there have been shown and described what are at present considered the preferred embodiments of the present invention, it will be obvious to those skilled in the art that various changes and modifications may be made therein without departing from the scope of the invention as defined by the appended claims.

What is claimed is:

1. An electric lamp comprising:

a tubular closed-loop electrodeless lamp envelope enclosing mercury vapor and a buffer gas, said lamp envelope having a pair of dimples on an inside surface thereof; and a flag assembly located within said lamp envelope, said flag assembly comprising a support wire having opposite ends secured to said dimples and a starting flag attached to said support wire, said starting flag including a mercury absorbing material.

2. An electric lamp as defined in claim 1 wherein said dimples have an outwardly-extending, concave structure and wherein the opposite ends of said support wire are disposed in said dimples.

3. An electric lamp as defined in claim 1 wherein said dimples have an inwardly-extending, convex structure and wherein the opposite ends of said support wire have loops disposed around said dimples.

4. An electric lamp as defined in claim 1 wherein said lamp envelope includes a first region of a first inside diameter and a second region of a second inside diameter that is smaller than said first inside diameter and wherein said flag assembly is located in said second region.

5. An electric lamp as defined in claim 1 wherein said tubular lamp envelope has a central axis and wherein said dimples are disposed on opposite sides of said central axis.

6. An electric lamp as defined in claim 1 wherein said support wire is a material selected from the group consisting of nickel-plated steel, stainless steel, molybdenum and tungsten.

7. An electric lamp as defined in claim 1 wherein said support wire is a material selected to maintain stiffness at the temperature within the lamp discharge.

8. An electric lamp as defined in claim 1 wherein said starting flag comprises a molecular sieve coating on a section of expanded stainless steel foil.

9. An electric lamp as defined in claim 1 wherein said starting flag comprises a non-volatile, mercury-absorbing metal.

10. An electric lamp as defined in claim 1 wherein said starting flag comprises a non-volatile, mercury-absorbing alloy.

11. An electric lamp as defined in claim 1 wherein said lamp envelope comprises glass having said dimples integrally formed therein.

12. An electric lamp as defined in claim 1 further including an amalgam located at a cold spot within said lamp envelope, wherein said flag assembly is remotely located from said amalgam.

13. An electric lamp as defined in claim 1 wherein said lamp envelope comprises first and second parallel tubes joined at or near one end by a first lateral tube and joined at or near the other end by a second lateral tube and wherein said flag assembly is located in said first lateral tube.

14. An electric lamp as defined in claim 13 wherein said first lateral tube has a smaller diameter than said parallel tubes.

15. An electric lamp as defined in claim 13 further including an amalgam located in said second lateral tube.

16. An electric lamp as defined in claim 1 wherein said starting flag is centered in said tubular lamp envelope.

17. An electric lamp assembly comprises:

an electrodeless, closed-loop, tubular lamp envelope enclosing mercury vapor and a buffer gas, said lamp envelope having a pair of dimples on an inside surface thereof;

a flag assembly located within said lamp envelope, said flag assembly comprising a support wire having opposite ends secured to said dimples and a starting flag attached to said support wire, said starting flag including a mercury-absorbing material;

a transformer core disposed around said lamp envelope;

an input winding disposed on said transformer core; and a radio frequency power source coupled to said input winding for supplying sufficient radio frequency energy to said mercury vapor and said buffer gas to produce a discharge in said lamp envelope.

18. An electric lamp assembly as defined in claim 17 wherein said dimples have an outwardly-extending, concave structure and wherein the opposite ends of said support wire are disposed in said dimples.

19. An electric lamp assembly as defined in claim 17 wherein said dimples having an inwardly-extending, convex structure and wherein the opposite ends of said support wire have loops disposed around said dimples.

20. An electric lamp assembly as defined in claim 17 further comprising an amalgam located within said lamp envelope.

21. An electric lamp assembly as defined in claim 17 wherein said tubular lamp envelope has a central axis and wherein said dimples are disposed on opposite sides of said central axis.

22. An electric lamp assembly as defined in claim 17 wherein said starting flag is centered in said tubular lamp envelope.

23. An electric lamp assembly as defined in claim 17 wherein said starting flag comprises a molecular sieve coating on a section of expanded stainless steel foil.

24. An electric lamp assembly comprising:

an electrodeless lamp envelope including a tubular lamp envelope enclosing mercury vapor and a buffer gas, said lamp envelope comprising first and second parallel tubes joined at or near one end by a first lateral tube and joined at or near the other end by a second lateral tube to form a closed loop, said lamp envelope having a pair of dimples on an inside surface thereof;

a flag assembly located within said lamp envelope, said flag assembly comprising a support wire having opposite ends secured to said dimples and a starting flag attached to said support wire, said starting flag including a mercury-absorbing material;

a first transformer core disposed around the first lateral tube of said lamp envelope;

a second transformer core disposed around the second lateral tube of said lamp envelope;

first and second input windings disposed on said first and second transformer cores, respectively; and a radio frequency power source coupled to said first and second input windings for supplying sufficient radio frequency energy to said mercury vapor and said buffer gas to produce a discharge in said lamp envelope.

25. An electric lamp assembly as defined in claim 24 wherein said dimples have an outwardly-extending, concave structure and wherein the opposite ends of said support wire are disposed in said dimples.

26. An electric lamp assembly as defined in claim 24 wherein said dimples have an inwardly-extending, convex structure and wherein the opposite ends of said support wire have loops disposed around said dimples.

27. An electric lamp assembly as defined in claim 24 further comprising an amalgam located within said lamp envelope.

28. An electric lamp assembly as defined in claim 24 wherein said tubular lamp envelope has a central axis and wherein said dimples are disposed on opposite sides of said central axis.

29. An electric lamp assembly as defined in claim 24 wherein said starting flag is centered in said tubular lamp envelope.

30. An electric lamp assembly as defined in claim 24 wherein starting flag comprises a molecular sieve coating on a section of expanded stainless steel foil.

31. An electric lamp assembly as defined in claim 24 wherein said first lateral tube has a smaller diameter than said first and second parallel tubes and wherein flag assembly is located in said first lateral tube.

* * * * *